US005494234A

United States Patent [19]

Kramer

[11] Patent Number: 5,494,234

[45] Date of Patent: Feb. 27, 1996

[54] MULTIPLE SPHERES AND CABLE DEPLOYER

[75] Inventor: Richard E. Kramer, Damascus, Md.

[73] Assignee: Fairchild Space and Defense Corporation, Germantown, Md.

[21] Appl. No.: 193,463

[22] Filed: Feb. 8, 1994

[51] Int. Cl.[6] ..... B65H 75/48; H01Q 1/30

[52] U.S. Cl. ..... 242/390.2; 242/390.8; 343/707

[58] Field of Search ..... 242/390.2, 390.8, 242/390.3; 343/707, 877

[56] References Cited

U.S. PATENT DOCUMENTS

| | | | |
|---|---|---|---|
| 2,137,450 | 11/1938 | Green | 343/877 X |
| 3,191,880 | 6/1965 | Visconti | 242/390.8 X |
| 4,227,678 | 10/1980 | Laky | 242/390.2 X |
| 4,556,889 | 12/1985 | Buehler | 343/707 |
| 5,326,040 | 7/1994 | Kramer | 242/390.2 |
| 5,363,565 | 11/1994 | Kaneko | 242/395 X |

FOREIGN PATENT DOCUMENTS

| | | | |
|---|---|---|---|
| 928841 | 12/1947 | France | 343/707 |

*Primary Examiner*—John Q. Nguyen
*Attorney, Agent, or Firm*—Michael W. York

[57] ABSTRACT

A sphere and cable deployer apparatus for deploying a cable and associated spheres from a vehicle such as a spinning satellite. The sphere and cable deployer apparatus has a drum for storing the cable that is driven by a drive shaft and gears form a drive motor to deploy the cable and sphere away from the satellite. The drive motor also drives a drive roller through a series of gears and clutch that applies tension to the cable as it is being unwound from the drum. The sphere and cable deployer apparatus also has a housing with an outer and inner pair of shell-like halves that pivot outward due to spring forces to release the spheres. Each pair of pivoting housing halves also provide a storage compartment for a short cable portion that is attached to that sphere. The outer set of pivoting housing halves are held in place by two cables that are under tension and associated pins that fit in holes in the housing halves and are released by cable cutters that cut the cables, and the inner housing halves are held in place by explosive bolts that may be activated by a protrusion on the cable portion located between the spheres and an associated microswitch as the cable portion is deployed.

13 Claims, 2 Drawing Sheets

SPACECRAFT
SPIN AXIS

MULTIPLE SPHERES AND CABLE DEPLOYER

BACKGROUND OF THE INVENTION

Spheres that are located at or near the end of a cable can have a number of uses. A typical use would be to deploy the cable and attached sphere from a vehicle. For instance, U.S. Pat. No. 4,556,889 discloses the deployment of a sphere at the end of a coaxial transmission feed line from an aircraft for use as an antenna. In this situation the cable is extended by deploying it through a suitably sized opening in the fuselage of an aircraft to trail the cable and the attached sphere behind the aircraft. As indicated in the U.S. Pat. No. 4,556,889 this antenna configuration provides an efficient antenna with very low loss that also exhibits minimal aerodynamic drag when deployed from the aircraft. The antenna is also comparatively inexpensive to manufacture.

The antenna disclosed in this patent is capable of being used both for transmitting and receiving information and it has substantially uniform transmission and reception characteristics in three dimensional space. Such features are highly desirable for both communication and surveillance.

It has also been proposed to use such a cable and sphere system with a spacecraft and in particular a spinning spacecraft that would spin cables and spheres near the outer end portions of the cables around the spinning spacecraft. Such proposed spacecraft usage presents serious problems for storing the sphere and cable system during the launch of the spacecraft and while the spacecraft is travelling to its destination in space since the spacecraft is subjected to large G loads as well as vibrations that could damage the spheres and associated structure. Such G loads and vibrations are generally not present with aircraft or at least no where near the magnitude of the G loads and vibrations that a spacecraft will experience.

The actual deployment of the cable sphere system from an aircraft is comparatively simple and a simple manually operated reel type device could be used. However, the actual deployment from a spinning spacecraft is much more complex in order to deploy the cables and attached spheres so that they are properly oriented around the spacecraft.

The sphere and cable deployer invention deploys a plurality of spheres connected to one cable at two different locations along the cable and hence the previously mentioned problems are aggravated due to the complexity associated with the storage and deployment of a plurality of spheres on one cable. In spite of these potential problems, the sphere and cable deployer invention is constructed to provide for the safe launch of a multiple sphere and cable system in a spacecraft and then the deployer has provision for sequentially deploying the spheres and associated cable portions outside the spacecraft as the spacecraft rotates so as to enable the spheres and cable to be properly located around the spacecraft.

BRIEF DESCRIPTION OF THE INVENTION

This invention relates to deployment apparatus for deploying spheres and the like and associated attached cable portions and more particularly to deployers for deploying spheres and associated cable portions from a vehicle.

Accordingly, it is an object of the invention to provide a sphere and cable deployer that effectively deploys or releases a plurality of spheres and associated connected cable portions.

It is an object of the invention to provide a sphere and cable deployer that effectively secures the spheres and associated cable portions when the spheres and cable portions are not deployed.

It is an object of the invention to provide a sphere and cable deployer that is suitable for use on a vehicle.

It is an object of the invention to provide a sphere and cable deployer that is particularly suited for use on a spacecraft.

It is an object of the invention to provide a sphere and cable deployer that protects the spheres and cable portions from the forces exerted on a spacecraft when the spacecraft is launched.

It is an object of the invention to provide a sphere and cable deployer that houses or secures the spheres and associated cable portions in a compact manner.

It is an object of the invention to provide a sphere and cable deployer that takes up comparatively very little room on a spacecraft.

It is also an object of the invention to provide a sphere and cable deployer that is particularly adapted to be used to transport spheres and associated cables within a spacecraft as the spacecraft moves in space.

It is an object of the invention to provide a sphere and cable deployer that can readily deploy spheres and an attached cable portion from a spacecraft.

It is an object of the invention to provide a sphere and cable deployer that can deploy spheres and attached cable portions so that they are properly positioned outside the spacecraft.

It is an object of the invention to provide a sphere and cable deployer that is particularly useful in deploying spheres and attached cable portions from a rotating spacecraft.

It is an object of the invention to provide a sphere and cable deployer that sequentially deploys spheres and a plurality of associated cable portions to provide for their accurate placement when deployed.

It is an object of the invention to provide a sphere and cable deployer that requires very little electrical power to operate.

It is an object of the invention to provide a sphere and cable deployer that places very little electrical demand upon the power supply of the spacecraft in which it is located.

It is also an object of the invention to provide a sphere and cable deployer that has provisions for locating the spheres and associated cable portions in space.

It is an object of the invention to provide a sphere and cable deployer that has provisions for finely adjusting the location of the spheres and associated cable portions in space.

It is also an object of the invention to provide a sphere and cable deployer that provides an indication of the extent of deployment of the cable and associated spheres.

It is an object of the invention to provide a sphere and cable deployer that provides an electrical signal corresponding to the extent of deployment of the cable and associated spheres so that such information can be transmitted to a remote location.

It is also an object of the invention to provide a sphere and cable deployer that is capable of retracting the cable and associated spheres if desired.

These and other objects are obtained from the deploying apparatus invention for deploying an elongated member and connected objects such as a cable and spheres that includes a storage drum for storing at least a portion of the elongated member and a housing for storing the objects such as spheres connected to the elongated member. The housing includes two substantially identical clam shell like halves that are hinged together at one end and are biased by springs in an outward direction that contain the object such as the sphere. Another pair of similar clam shell like halves that are hinged together are also provided for housing another object such as a second sphere. The invention also includes release means for controlling the opening of the housings, or the two pair of clam shell like hinged halves to release the objects such as spheres that are connected to the elongated member. The release means includes means to secure the two pairs of clam shell like halves together when the spheres are in the stowed position. The deploying apparatus also has means for indicating the extent of the deployment of the cable or other elongated member and the associated objects such as spheres.

BRIEF DESCRIPTION OF THE DRAWINGS

The invention will be hereinafter more fully described with reference to the accompanying drawings in which.

DETAILED DESCRIPTION OF THE PREFERRED EMBODIMENTS

Figures 1, 3, 4, 5:
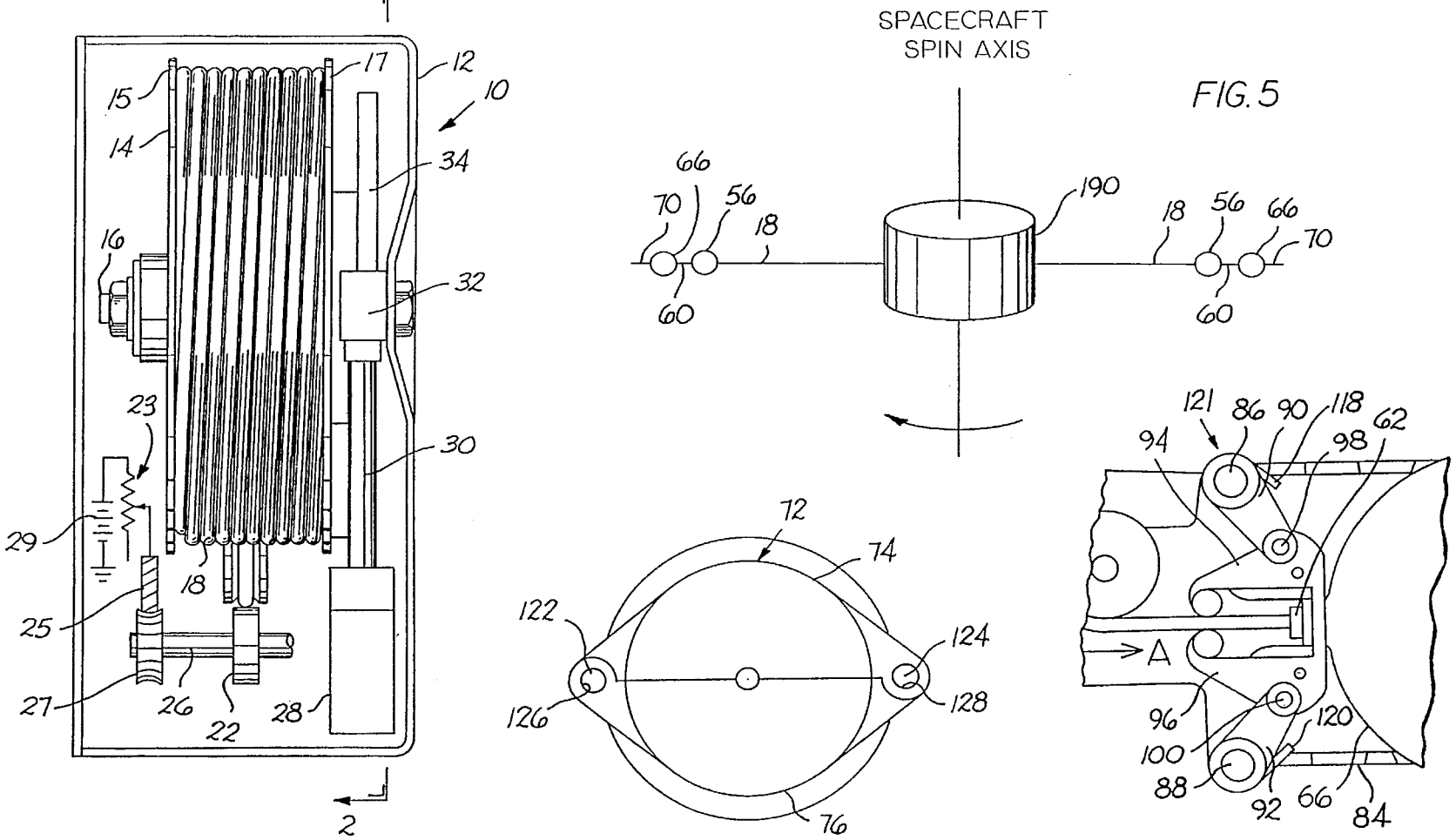
FIG. 1 is an end elevational view of the deploying apparatus invention.
FIG. 3 is an enlarged view of a portion of the deploying apparatus structure illustrated in FIG. 2 taken substantially within the circle 3 thereof.
FIG. 4 is an enlarged view of a portion of the deploying apparatus structure illustrated in FIG. 2 taken substantially in the direction of the line 4—4 thereof.
FIG. 5 is a perspective view illustrating the deploying apparatus invention in use on a spacecraft with cables and associated multiple spheres deployed.

The deploying apparatus invention is illustrated in FIGS. 1, 2, 3 and 4 and is designated generally by the number 10. The deploying apparatus 10 comprises a substantially rectangular shaped housing 12, a generally cylindrical shaped storage spool 14 with its outer flanges 15 and 17 that is horizontally mounted within the housing 12 on a horizontal shaft 16 for storing an elongated member comprising a cable 18 that is stored by being wound around the outside surface of the storage spool 14 and a drive roller 20 and associated pressure roller 22 that are horizontally mounted within the housing 12 on the respective shafts 24 and 26 that are used to pull the cable 18 off of the storage spool 14 in a manner that will hereinafter be described in detail. A potentiometer 23 is connected to the pressure roller 22 through a worm 25 and a worm gear 27 that rotates on the shaft 26 that is also secured to and rotates with the roller 22 and this permits the determination of the amount of deployed cable 18 due to the rotation of the roller 22 and associated change in resistances of the potentiometer 23. Electrical power for the potentiometer 23 is supplied by the connected battery 29.

The deploying apparatus 10 also includes a drive motor 28 and associated drive shaft 30 and gear 32 that meshes with an associated gear 34 that is rigidly connected to the end of the storage spool 14 so that activation of the drive motor 28 causes rotation of the drive shaft 30, the gear 32 and the associated gear 34 and the attached storage spool 14.

Figure 2:
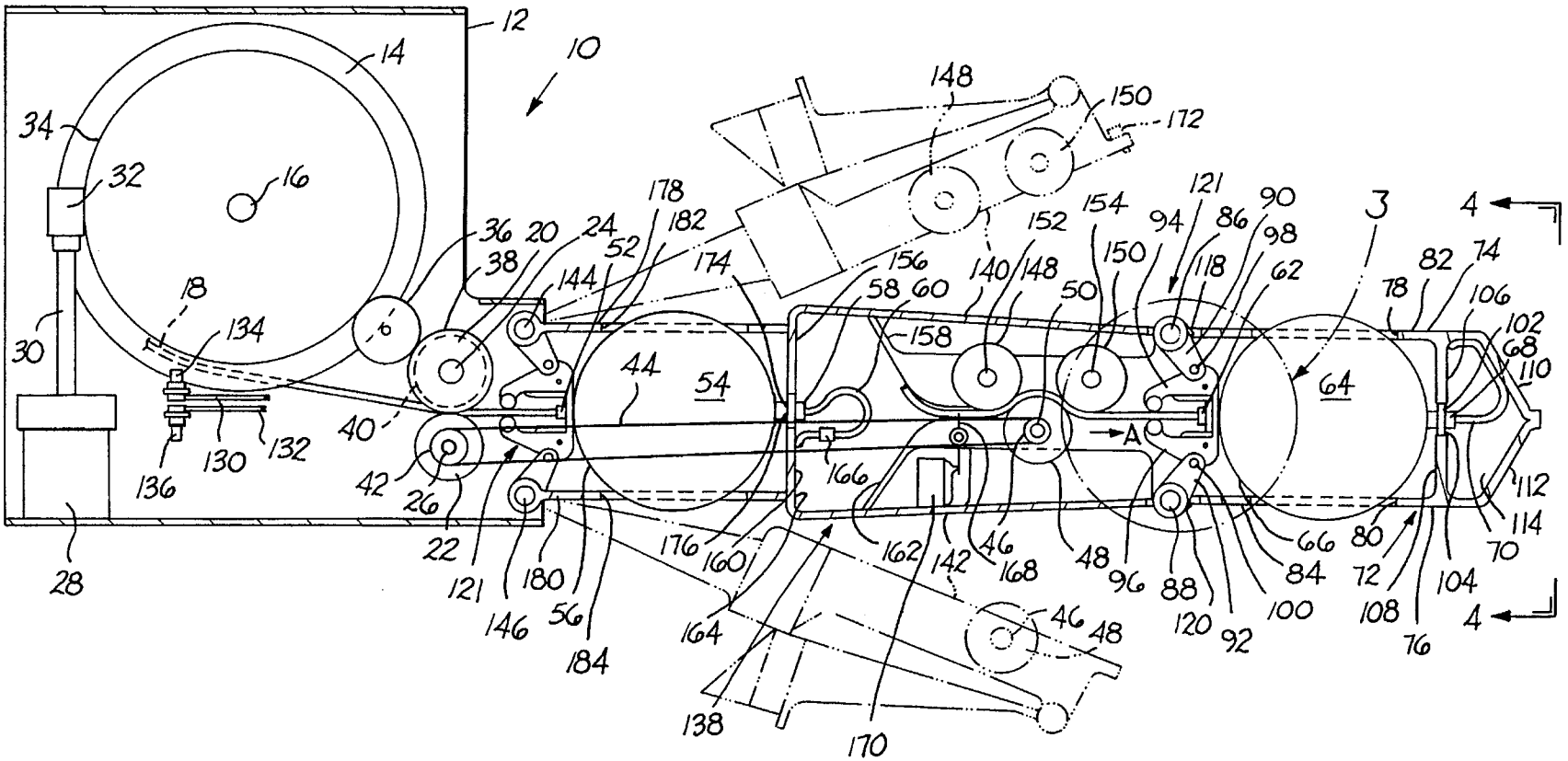
FIG. 2 is a sectional view of the deploying apparatus invention illustrated in FIG. 1 taken substantially on the line 2—2 thereof with certain parts illustrated in phantom lines to show their alternate positions.

As illustrated in FIG. 2, the drive motor 28 also drives the drive roller 20 through the idler gear 36 and associated slip clutch drive gear 38 that drives the friction slip clutch 40 that drives the shaft 24 that drives a one way drive clutch located inside the drive roller 20. The choice of the gear size should be such that the drive roller 20 rotates in a manner that it puts tension on the cable 18 since it is desirable to pull or remove the cable 18 from the storage spool 14 faster than the gears 32, 34 and the associated drive motor 28 want to rotate the storage spool 14. This is done to prevent slack in the cable 18 as the effective diameter of the coiled cable changes as the cable is unwound or wound on the storage spool 14.

The pressure roller 22 has a smaller diameter cylindrical projection 42 that is sized, shaped and located to engage a drive belt 44 that also fits around and engages a cylindrical projection 46 that projects from and is connected to a drive roller 48. The drive roller 48 is horizontally located by and rotates on a shaft 50. The purpose of the drive roller 48 is to assist in deploying a portion of the cable 18 in a manner that will be hereinafter described in detail.

As illustrated in FIG. 2, the cable 18 is connected to a cylindrical engaging member 52 that is in turn connected to one side of the outer surface 54 of an inboard sphere 56. The other side of the outer surface 54 of the inbound sphere 56 has another cylindrical member 58 connected to it that is in turn connected to a comparatively short piece of cable 60 that in the preferred embodiment is between ten and twenty meters long. The outer end of this cable 60 is connected to a cylindrical engaging member 62 that is substantially identical as the engaging member 52. This engaging member 62 is in turn connected to one side of the outer surface 64 of an outboard sphere 66 that is substantially identical to the inboard sphere 56. The other side of the outer surface 64 of the outboard sphere 66 also has a cylindrical engaging member 68 that is in turn connected to a comparatively short length of cable 70.

The deploying apparatus invention 10 also comprises an outer storage housing 72 for storing the sphere 66 that is attached to the engaging member 62 that in turn is attached to the outer end portion of the cable 60. The storage housing 72 comprises two substantially identical clam shell like halves 74 and 76. Each half, 74 and 76, has respective holes 78 and 80 in its outer walls 82 and 84 that are sized and shaped to permit a portion of the sphere 66 to extend through them when the halves 74 and 76 are in their closed or stowed positions. As illustrated in FIGS. 2 and 3, the halves 74 and 76 are pivotally mounted on the respective hinge pins 86 and 88 that are connected to the respective link members 90 and 92 that are in turn pivotally connected to respective support clamps 94 and 96 by the respective pivot pins 98 and 100.

These clamps 94 and 96 have jaws that are sized and shaped to grip the cylindrical engaging member 62 located around the cable 60 at a point where the cable 60 enters the inner surface of the sphere 66. The other cylindrical engaging member 68 that is located around a short length of a cable 70 that projects from the opposite side of the sphere 64 adjacent the outer surface 66 of the sphere 64. This engaging member 62 is engaged by recesses 102 and 104 in respective inner walls 106 and 108 located in the respective halves 74 and 76 when the halves 74 and 76 are in their stowed or closed positions. These walls 106 and 108 and the associated outer walls 110 and 112 form a compartment 114 for the stowed cable end portion 70 when the halves 74 and 76 are in their closed positions.

Coil springs 118 and 120 that are located around the respective pins 86 and 88 that also engage the respective halves 74 and 76 provide a force to rotate these halves 74 and 76 in an outward direction. The clamps 94 and 96, the link members 90 and 92, the associated pins 98 and 100 and the associated springs 118 and 120 form a clamping assembly designated generally by the number 121. Normally, as illustrated in FIG. 4, the halves 74 and 76 are secured together by the respective release pins 122 and 124 located in the respective holes 126 and 128. These pins 122 and 124 prevent the halves 74 and 76 from moving outward when the halves 74 and 76 are in their stowed positions. These pins 122 and 124 are connected to the respective cables 130 and 132 that in turn are connected to pyro type cable cutters 134 and 136 that cut the respective cables 130 and 132 that then activate or remove the pins 122 and 124 to cause the halves 74 and 76 to move outward as a result of the forces exerted by the springs 118 and 120.

The outer storage housing 72 is pivotally connected to an inner storage housing designated generally by the number 138 by the pivot pins 86 and 88 that pivotally connect the respective halves 74 and 76 of the outer storage housing to respective clam shell like halves 140 and 142 that are pivotally connected to the main housing 12 by the respective pivot pins 144 and 146. As illustrated, the clam shell half 142 has the drive roller 48 and associated projection 46 that are mounted on the shaft 50 that is in turn secured to the housing half 142. The other clam shell like half 140 contains two substantially identical pressure rollers 148 and 150 that are secured to the housing half 140 by the respective pins 152 and 154. The purpose of the pressure rollers 148 and 150 is to press against the cable portion 60 and push or press it against the drive roller 48 so that when the drive roller 48 rotates as the projection 46 is rotated by the belt 44 this causes the cable portion 60 to be pulled outward in the direction of the arrow A. It should be noted that the projections 42 and 46 offset the belt 44 to one side so that it clears the sphere 56.

The halves 140 and 142 have the respective walls 156 and 158 and 160 and 162 that form a storage compartment 164 for a portion of the cable portion 60 when the halves 140 and 142 are in their closed positions. It should be noted that the inner portion of the stored cable portion 60 has a cylindrical enlarged activating member 166 located around it. The purpose of this enlarged member 166 is to engage the trigger member 168 of a microswitch 170 as the cable portion 60 is moved outward as a result of the rotating drive roller 48. The microswitch 170 then activates, through conventional circuitry (not shown), explosive bolts 172 (shown in phantom in FIG. 2) to release the halves 140 and 142 so they assume the positions illustrated in phantom in FIG. 2.

As illustrated in FIG. 2, the walls 156 and 158 have respective recesses 174 and 176 that engage the cylindrical member 58 that is attached to the sphere 56. The inner portion of the inner housing 138 has outer walls 178 and 180 with respective holes 182 and 184 that receive portions of the sphere 56 to secure the sphere in place inside the inner housing 138. The cylindrical projection 52 on the inner surface 54 of the sphere 56 is releasable secured by a clamping assembly 121 that is identical to the previously described clamping assembly 121 associated with the outer housing 72. The clamping assembly 121 associated with the inner housing 138 biases the housing halves 140 and 142 outwardly to assume the positions illustrated in phantom when the halves 140 and 142 are released.

The deploying apparatus invention 10 is manufactured in the following manner. The housing 12 is manufactured from metallic sheet materials and/or from combined metallic and composite sheet materials and spacers through techniques known in the art. The drum member 14 can be fabricated using known techniques from a suitable combination of metallic or composite materials. The rollers 20, 22, 46, 48, 148 and 150 and the housings 72 and 138 can be manufactured from fiber glass or aluminum using techniques known in the art. The spheres 56 and 66 should be manufactured using known techniques from a non-magnetic material which could be aluminum or a composite of non-metallic materials with a conductive outer coating. The clamps 94 and 96 and also the link members 90 and 92 may be made from a metallic or non-metallic material through the use of known techniques. The motor 28, the worm 25, the worm gear 27, the shaft 26, the drive shaft 30 and associated gears 32, 34, 36 and 38 as well as the potentiometer 23 are conventional items known in the art. The other components including the cable 18, microswitch 170 and explosive bolts 172 are basic items known in the art and they are manufactured using techniques and materials known in the art.

The deploying apparatus invention 10 is used in the following manner. When the vehicle such as the spacecraft 190 illustrated in FIG. 5, is located at the desired location in space, the pyro cable cutters 134 and 136 are activated by means known in the art that do not form part of the invention to cut the respective cables 130 and 132. When these cables 130 and 132 that are under tension are cut this causes the connected pins 122 and 124 illustrated in FIG. 4 to leave their respective holes 126 and 128. As a result, as illustrated in FIG. 2, the clam shell like housing halves 74 and 76 move outward due to the action of the springs 118 and 120 and this frees the sphere 66 and associated cable portion 70.

The drive motor 28 illustrated in FIG. 2 is then activated in a conventional manner and through the action of the drive shaft 30, gears 32 and 34, idler gear 36, drive gear 38, and frictional clutch 40 and the drive roller 20 and associated pressure roller 22 this causes the cable 60 to be pulled out of storage compartment 164. Also, the roller 22 is caused to rotate as well as the connected roller 42 that has the belt 44 located around it. The belt 44 in turn causes the rotation of the smaller diameter roller 46 that causes the attached roller 48 to also rotate. The rotation of the roller 48 that contacts the cable portion 60 results in an outward pulling force on the cable portion 60 in the direction of the arrow A since the pressure rollers 148 and 150 press the adjacent portion of the cable 60 against the roller 48.

Since the diameter of the roller 46 is substantially less than the diameter of the roller 42, the cable portion 60 is pulled out faster than the rest of the cable 18. Consequently, the cable portion 60 is pulled outward first. However, when the enlarged portion 166 on the cable 60 engages the trigger member 168 of the microswitch 170 this causes activation of the explosive bolts 172 and this results in the sphere housings halves 74, 76, 140 and 142 assuming the positions illustrated in phantom in FIG. 2. As a consequence the inner sphere 56 is released. The drive roller 20 and the pressure roller 22 continue to cause the cable 18 to be pulled off of the drum 14 until the spheres 56 and 66 and the associated cable 18 reach their deployed positions. At this time power to the drive motor is shut off through means known in the art (not shown). In view of the potentiometer 23 illustrated in FIG. 1 connected to the back up roller 22 the exact amount of the cable 18 that has been deployed can be determined and hence the amount of cable 18 that is deployed can be accurately controlled.

Usually one or more pairs of two deploying apparatus 10 would be used on a single spacecraft 190 as illustrated in FIG. 5. This results in two cables 18 and the connected spheres 56 and 66 being deployed from opposite sides of the spacecraft 190 that in most cases would be spinning about its spin axis. Typically the inner sphere 56 and associated cables 18 would be deployed for approximately some fifty meters outside the spacecraft 190 and the outer cable 70 would extend approximately an additional one meter beyond the spheres 66. In the preferred embodiment the cable 60 between the deployed spheres 56 and 66 would have a length between approximately ten and twenty meters. Normally, although they may be partially retracted by reversing the drive motor 28 direction of operation, once the cables 18 and associated spheres 56 and 66 and the outer short cables 70 are deployed they will not be fully retracted and hence there is no provision for reclosing the halves 74 and 76 of the outer storage housing 72 and the halves 140 and 142 of the inner storage housing.

Although the invention has been described in considerable detail with reference to a certain preferred embodiment, it will be understood that variations or modifications may be made within the spirit and scope of the invention as defined in the appended claims.

What is claimed is:

1. Sphere and cable deploying apparatus comprising a cable member having two ends, a plurality of spherical members connected to said cable member, a storage drum for winding at least a portion of said cable member, one end of said cable member being attached to said drum and said spherical members being connected to said cable member adjacent the other end of said cable member, means connected to said storage drum for driving said storage drum, separately operable releasable storage means associated with each of said spherical members for releasably storing each of said spherical members and for permitting each spherical member to be individually released in a predetermined order, and means associated with said separately operable releasable storage means for activating said separately operable releasable storage means to cause the release of said spherical members.

2. The sphere and cable deploying apparatus of claim 1 wherein said means for activating said separately operable releasable storage means comprises means for activating one of said separately operable releasable storage means prior to another.

3. The sphere and cable deploying apparatus of claim 2 wherein said means for activating one of said separately operable releasable storage means prior to another comprises means for activating one of said separately operable releasable storage means as a result of previous activation of another separately operable releasable storage means and release of the stored spherical member from said previously activated separately operable releasable storage means.

4. The sphere and cable deploying apparatus of claim 1 wherein said separately operable releasable storage means are connected.

5. The sphere and cable deploying apparatus of claim 4 wherein said connected separately operable releasable storage means are pivotally connected.

6. The sphere and cable deploying apparatus of claim 5 wherein said pivotally connected separately operable releasable means comprise clam shell like housing halves.

7. The sphere and cable deploying apparatus of claim 1 wherein at least one of said separately operable releasable storage means also comprises means for storing a portion of said cable member.

8. The sphere and cable deploying apparatus of claim 7 wherein the portion of the cable member stored in the means for storing a portion of said cable member is operatively connected to the spherical member stored in the same separately operable releasable storage means.

9. The sphere and cable deploying apparatus of claim 8 wherein a portion of said means for activating said separately operable releasable storage means is connected to said cable member portion stored in the means for storing a portion of said cable member.

10. The sphere and cable deploying apparatus of claim 1 wherein said activating means comprises at least one release cable and means for cutting said release cable.

11. The sphere and cable deploying apparatus of claim 1 further comprising means for partially retracting said cable member.

12. The sphere and cable deploying apparatus of claim 1 further comprising means associated with said cable member for indicating the release of said cable member.

13. The sphere and cable deploying apparatus of claim 12 wherein said means for indicating the release of said cable member comprises means for indicating the extent of release of said cable member.

* * * * *